US009447579B2

(12) United States Patent
Kopish et al.

(10) Patent No.: US 9,447,579 B2
(45) Date of Patent: Sep. 20, 2016

(54) SLIDING DOOR AND PIVOTING DOOR FOR DEMOUNTABLE WALL SYSTEM

(71) Applicant: Krueger International, Inc., Green Bay, WI (US)

(72) Inventors: Andrew J. Kopish, Green Bay, WI (US); Michael Salzman, Quebec (CA); Nathan A. Quintal, De Pere, WI (US); Timothy J. LaFleur, Menasha, WI (US); James M. Durand, De Pere, WI (US)

(73) Assignee: Krueger International, Inc., Green Bay, WI (US)

( * ) Notice: Subject to any disclaimer, the term of this patent is extended or adjusted under 35 U.S.C. 154(b) by 0 days.

(21) Appl. No.: 14/461,836

(22) Filed: Aug. 18, 2014

(65) Prior Publication Data

US 2014/0352230 A1 Dec. 4, 2014

Related U.S. Application Data

(62) Division of application No. 14/163,202, filed on Jan. 24, 2014, now Pat. No. 9,027,295.

(60) Provisional application No. 61/759,504, filed on Feb. 1, 2013.

(51) Int. Cl.

| | |
|---|---|
| ***E04B 2/74*** | (2006.01) |
| ***E04B 2/72*** | (2006.01) |
| ***E06B 3/02*** | (2006.01) |
| ***E06B 1/52*** | (2006.01) |
| ***E06B 3/30*** | (2006.01) |
| ***E06B 3/36*** | (2006.01) |
| ***E06B 3/70*** | (2006.01) |
| *E06B 3/46* | (2006.01) |

(52) U.S. Cl.
CPC . *E04B 2/72* (2013.01); *E04B 2/74* (2013.01); *E06B 1/52* (2013.01); *E06B 3/02* (2013.01); *E06B 3/301* (2013.01); *E06B 3/36* (2013.01); *E06B 3/70* (2013.01); *E06B 3/46* (2013.01)

(58) Field of Classification Search
CPC ..... E05D 15/14; E06B 3/42; E06B 3/46; E06B 3/4618; E06B 3/4636; E06B 3/4645
USPC ..... 52/126.3, 205, 207, 217, 238.1, 239, 52/243, 645, 656.2; 49/505; 160/21
See application file for complete search history.

(56) References Cited

U.S. PATENT DOCUMENTS 4,103,463 A * 8/1978 Dixon ..... 52/126.4
6,058,665 A * 5/2000 Halvorson et al. ..... 52/205
7,610,718 B2 11/2009 Kopish

FOREIGN PATENT DOCUMENTS

CA 2637080 A1 5/2009
MX 290104 9/2011

OTHER PUBLICATIONS

Basic Installation Manual, Genius Movable Walls, KI, Apr. 2013.

*Primary Examiner* — William Gilbert
(74) *Attorney, Agent, or Firm* — Andrus Intellectual Property Law, LLP

(57) ABSTRACT

A demountable modular wall system including a series of individual wall panels that can be positioned adjacent to each other. The demountable system includes a doorway defined by a pair of spaced vertical posts and a horizontal header. In one embodiment, a sliding glass door is movable along a sliding door track mounted to the horizontal header. A lower trim assembly mounted to the bottom end of the sliding glass door adjusts the overall height of the door. The doorway can also include a pivoting glass door. The pivoting glass door includes a bottom pivot assembly having a bottom clamp adjustably positioned along a bottom end of the pivoting glass door. The adjustable bottom clamp can be moved along the bottom end of the pivoting glass door and receives a pivot pin supported on the floor. A top pivot assembly includes a movable plunger that defines a portion of the pivot axis for the pivoting glass door.

8 Claims, 11 Drawing Sheets

FIG. 9
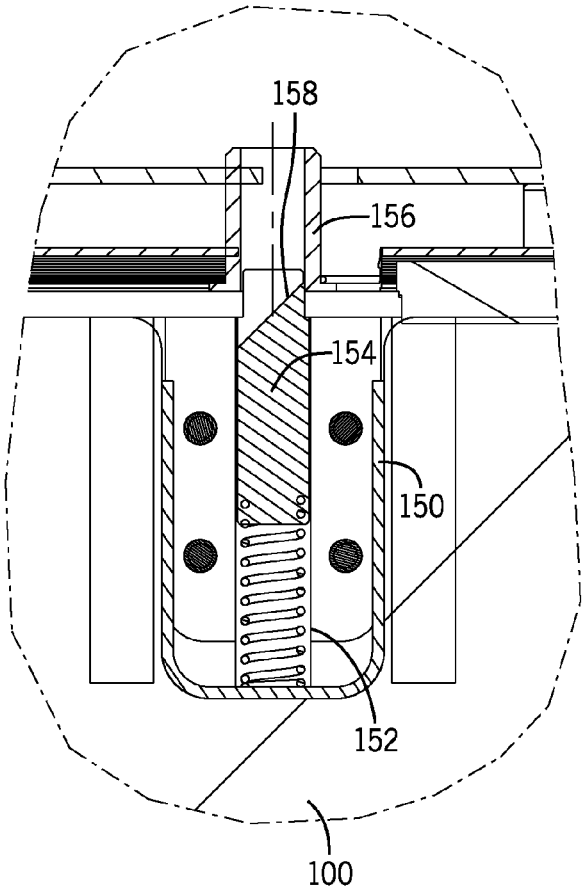
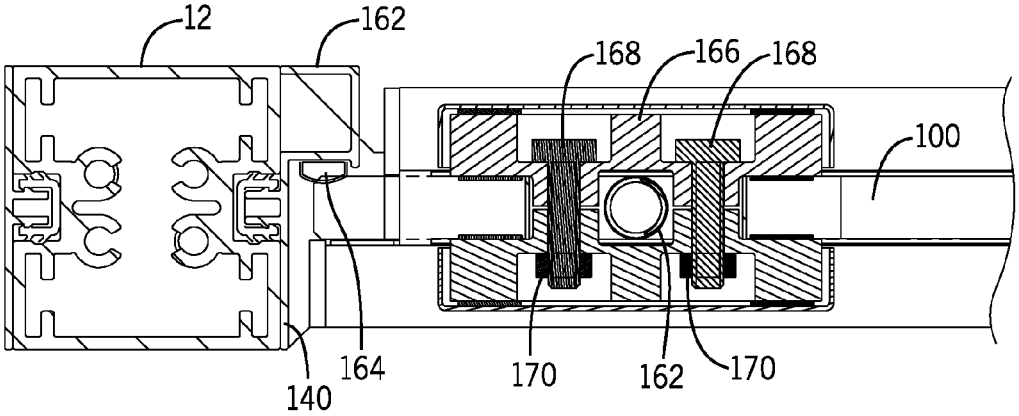
FIG. 10

FIG. 11
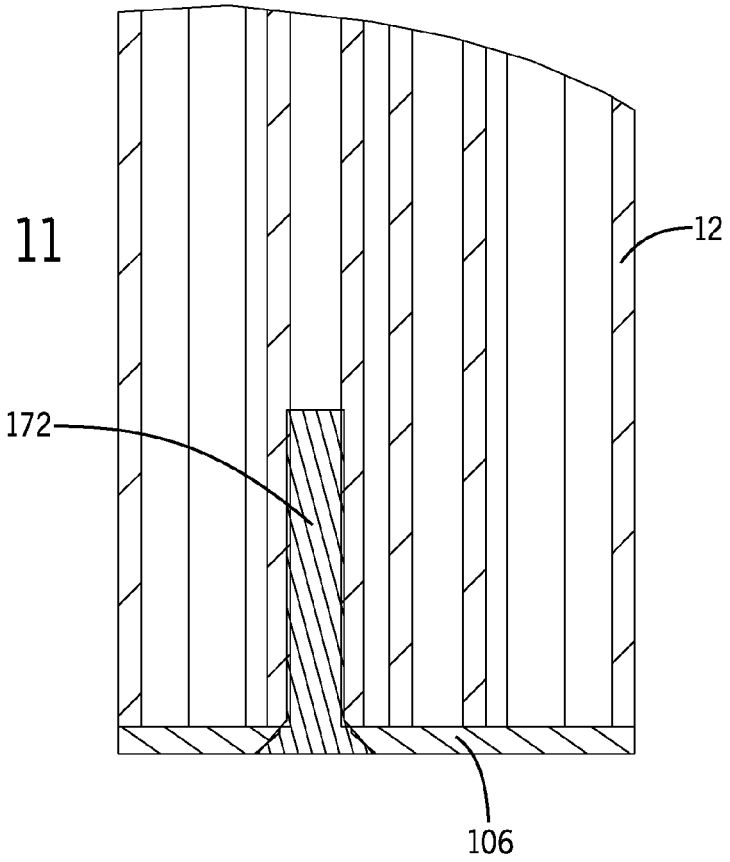
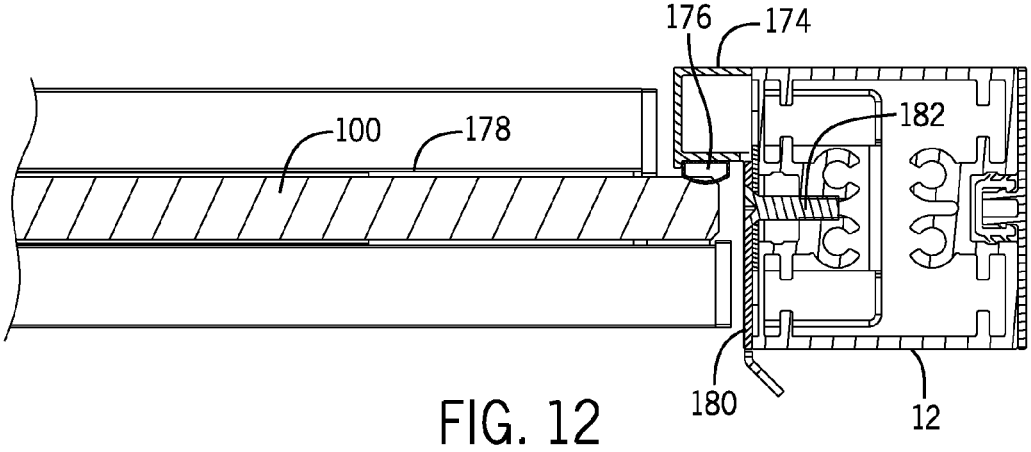
FIG. 12

SLIDING DOOR AND PIVOTING DOOR FOR DEMOUNTABLE WALL SYSTEM

CROSS REFERENCE TO RELATED APPLICATION

This application is a divisional application of prior U.S. patent application Ser. No. 14/163,202, filed on Jan. 24, 2014, which claims priority to U.S. Provisional Application No. 61/759,504, filed on Feb. 1, 2013 entitled SLIDING DOOR AND PIVOTING DOOR FOR DEMOUNTABLE WALL SYSTEM.

BACKGROUND

The present disclosure generally relates to a wall panel system. More specifically, the present disclosure relates to both a sliding door and a pivot door that can be used with a wall panel system that includes laminated glass panels.

Panel-type wall systems are commonly used to divide space in an open-plan office environment. In a typical modular panel-type wall system, a number of wall panels are interconnected together in a configuration suitable for the intended use of the space. Each wall panel typically includes a structural flame to which a pair of tiles are mounted. The tiles may be broadly classified as either decorative tiles or functional tiles. Decorative tiles have an acoustic insulating material covered by an appropriate finishing material such as fabric, metal or wood and are designed to provide sound proofing and aesthetic appearance. Functional tiles generally have a tile frame that supports functional components, such as a tool rail, one or more hooks, an opening, a window, a shelf, a marker board, paper management components, etc.

The large number of panel-type wall systems currently available allow a business owner to divide an open space into a series of enclosed areas. Although panel-type wall systems are commonly available, the solid surfaces used in most panel systems create an enclosed area that may not have any exterior windows or any other types of glass areas open to allow light to enter into the enclosed area.

Presently, modular wall systems have been developed that include glass panels as the structural elements rather than just as windows within a typical panel system. The demountable wall systems that use tempered or laminated glass as the primary exposed surface increase the amount of light that reaches into the enclosed area defined by the wall panel. However, utilizing glass panels instead of solid, structural panels creates certain challenges since structural components of the panel systems are viewable through the glass panel members.

SUMMARY

The present disclosure generally relates to a wall panel system that includes a series of wall panels and a doorway defined by a pair of spaced vertical support posts and a horizontal header. The doorway can include either a sliding glass door or a pivoting glass door depending upon the user requirements.

In an embodiment in which the modular wall system includes a sliding door, the sliding door is supported by a sliding door track that is mounted to the horizontal header. The sliding door track is positioned adjacent to the horizontal header and extends along the entire length of the horizontal header and past one of the pair of spaced vertical posts. The sliding glass door is movable along the sliding door track to open and close the doorway.

The sliding glass door is attached to at least a pair of trolley assemblies that are each movable along the sliding door track. Each of the trolleys is connected to the sliding glass door by a mounting bracket. The mounting bracket securely supports the sliding glass door between the trolleys such that the sliding glass door moves along with the trolleys within the sliding door track.

The mounting brackets attached to the sliding glass door are adjustably connected to a trolley such that the distance between the upper end of the sliding glass door and the sliding door track can be adjusted. In this manner, the vertical height of the sliding glass door can be modified to compensate for adjustments in the panels of the wall panel system.

The sliding glass door further includes a lower trim assembly that is mounted to a lower end of the sliding glass door. The lower trim assembly is adjustable to modify the overall height of the sliding glass door. In this manner, the trim assembly can be slightly modified to compensate for adjustments made to the panels of the wall panel system.

The lower trim assembly includes a bottom clamp that is attached to the lower end of the sliding glass door. The position of the bottom clamp can be adjusted relative to the lower end of the sliding door. The adjustment made between the bottom clamp and the door are facilitated by a series of spaced attachment holes that are each sized to receive a connector that passes through a mounting hole formed in the sliding glass door. The bottom clamp can be adjusted such that the connector passes through a selected one of the spaced attachment holes.

In an alternate embodiment in which the modular wall system includes a pivoting glass door, the pivoting glass door is mounted and supported by a bottom pivot assembly and a top pivot assembly. The pivoting glass door is not supported on either one of the spaced vertical posts that defines the doorway and is instead supported by the bottom pivot assembly.

The bottom pivot assembly of the pivoting glass door includes a bottom clamp that is securely attached to the bottom end of the pivoting glass door. The position of the bottom clamp is adjustable relative to the bottom end of the pivoting glass door such that the overall vertical height of the pivoting glass door can be adjusted to compensate for adjustments made in the wall panels of the wall panel system.

The bottom clamp, when mounted to the bottom end of the pivoting glass door, receives a pivot pin that is supported on the floor of a building. The support provided by the pivot pin allows the pivoting glass door to pivot about a pivot access while a pivot pin supports the weight of the glass door.

The top pivot assembly is mounted to the top end of the pivoting glass door and defines a top end of the pivot access. The top pivot assembly includes a plunger that is received within the upper header to pivotally support the top end of the pivoting glass door. The plunger is biased into an extended position by a bias spring such that the plunger is received within a bushing formed within the upper header.

An upper end of the plunger that forms a portion of the top pivot assembly includes a sloped upper surface such that the sliding glass door can be moved into position with the plunger retracted. Once in position, the bias spring urges the plunger into engagement with the bushing formed as part of the horizontal header. The combination of the bottom pivot assembly and top pivot assembly define a pivot access and support the weight of the pivoting glass door.

BRIEF DESCRIPTION OF THE DRAWINGS

The drawings illustrate the best mode presently contemplated of carrying out the disclosure. In the drawings:

FIG. 9 is a detailed view of the area shown by line 9-9 in FIG. 6;

FIG. 10 is a section view taken along line 10-10 of FIG. 6;

FIG. 11 is a section view showing the pivot plate attachment;

FIG. 12 is a section view taken along line 12-12 of FIG. 6;

DETAILED DESCRIPTION

Figure 1:
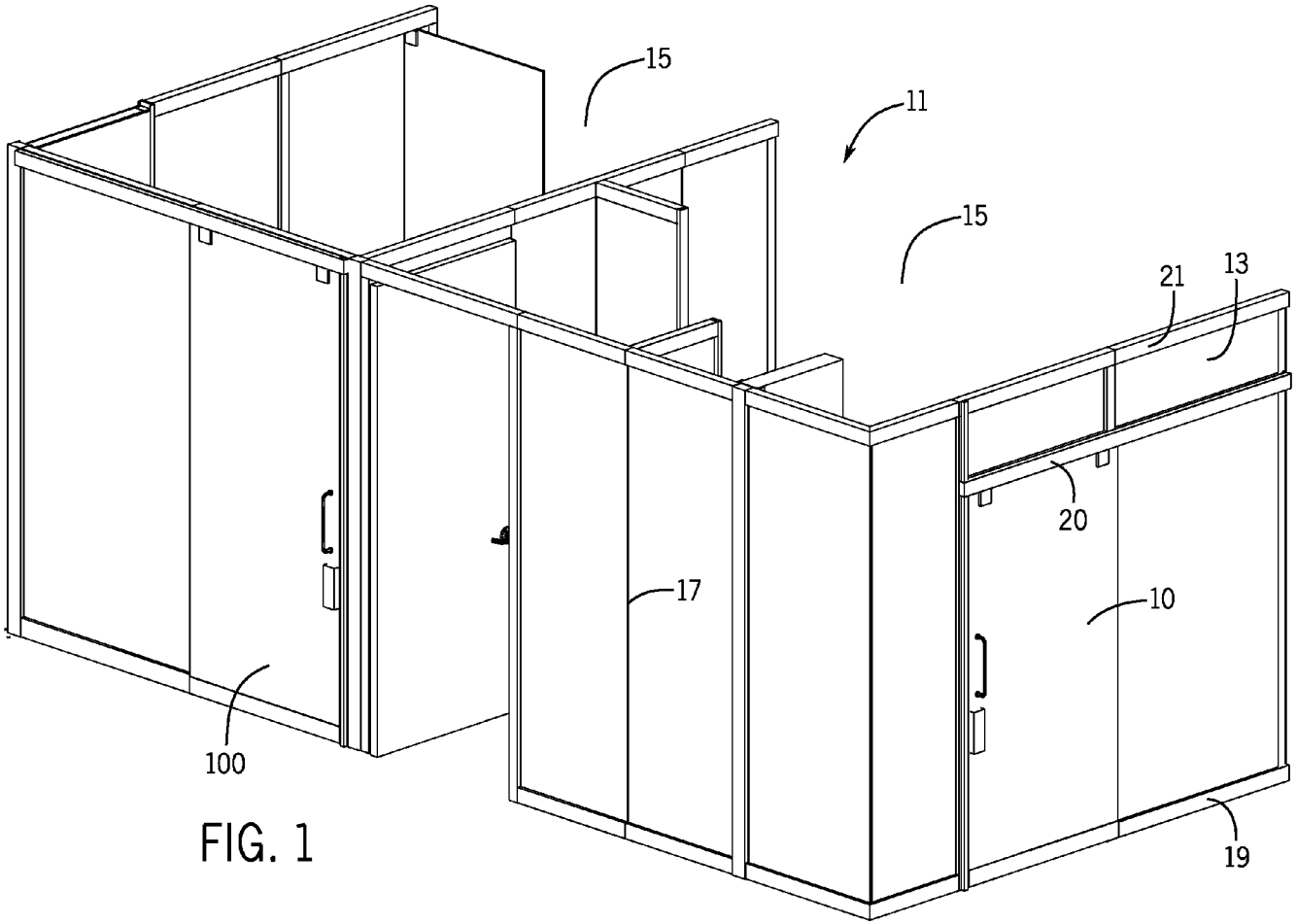
FIG. 1 is a perspective view of a demountable wall system of the present disclosure.

FIG. 1 illustrates a demountable wall system (DWS) 11 constructed in accordance with the present disclosure. The wall system 11 shown in FIG. 1 includes multiple glass panels 13 that can be used with conventional solid wall panels or with each other to create multiple rooms 15.

In the embodiment shown in FIG. 1, the wall system 11 includes a both a sliding door 10 and a pivoting glass door 100 that can each be used to selectively expose a doorway to enter into one of the rooms 15. In the embodiment shown in FIG. 1, the adjacent wall panels 13 abut each other to create a panel joint 17. In the embodiment illustrated, the panel joint is a butt-glazed joint in which one of the side edges of the adjacent wall panels 13 includes a bulb seal that creates a seal between the pair of adjacent wall panels at the panel joint. In addition, one of the pair of wall panels 13 that define the corner also include a bulb seal to create the joint between the pair of walls positioned at a 90° angle relative to each other.

As illustrated in FIG. 1, the demountable wall system 11 includes a lower trim 19 and an upper trim 21 that enhance the overall aesthetic appearance of the demountable wall system 11. In the embodiment shown in FIG. 1, both the lower trim 19 and the upper trim 21 are continuous sections that extend across multiple glass wall panels 13. The upper and lower trim sections are installed after the construction of the demountable wall system and provide a visually appealing appearance for the wall system 11.

Figure 1A:
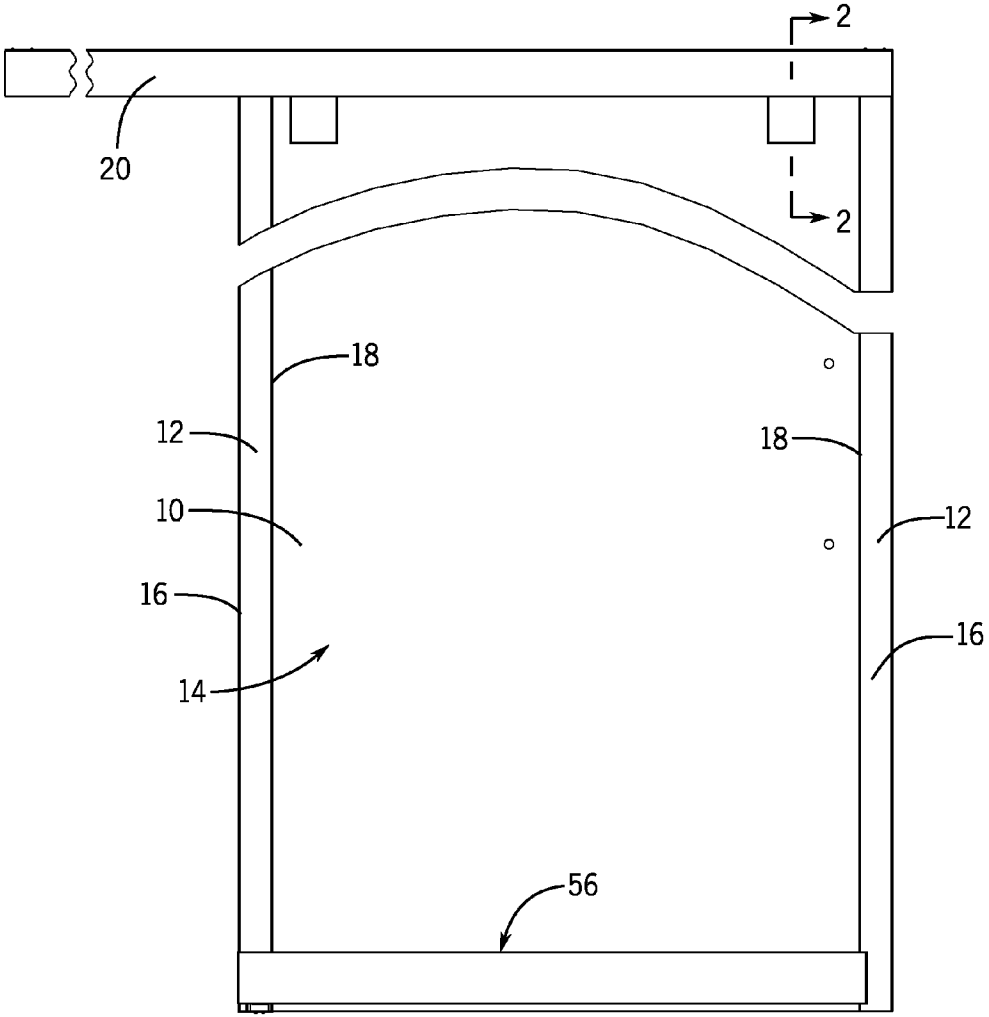
FIG. 1*a* is a front view of a sliding glass door assembly.

FIG. 1*a* illustrates one embodiment of the sliding glass door 10 constructed in accordance with the present disclosure. The sliding glass door 10 is designed for use with the demountable wall system 11 shown in FIG. 1 that includes multiple glass wall panels 13 that can be used with conventional solid wall panels or alone to create multiple rooms. The demountable wall system 11 includes the sliding glass door 10 that is movable between the closed position shown in FIG. 1*a* and an open position to provide entry and exit into one of the rooms created by the demountable wall glass system. In addition to utilizing the sliding door 10 shown in FIG. 1, it is also contemplated that a pivoting glass door could be utilized with the modular wall system 11, as will be described in greater detail below.

As illustrated in FIG. 1*a*, the demountable wall system includes a pair of vertical posts 12 that are spaced from each other to define an open doorway 14 that can be open and closed through the sliding movement of the glass door 10. When the glass door 10 is in the closed position shown in FIG. 1, the outer edges 16 of the glass door 10 extend past inner edges 18 of the doorway 14.

The glass door 10 is movable along a sliding door track 20 that allows the sliding door 10 to move from the closed position to an open position in which the sliding door 10 is moved completely away from the doorway 14. In FIG. 1*a*, the door track 20 includes a broken section; however, the length of the door track 20 should be at least twice the width of the glass door 10.

Figure 2:
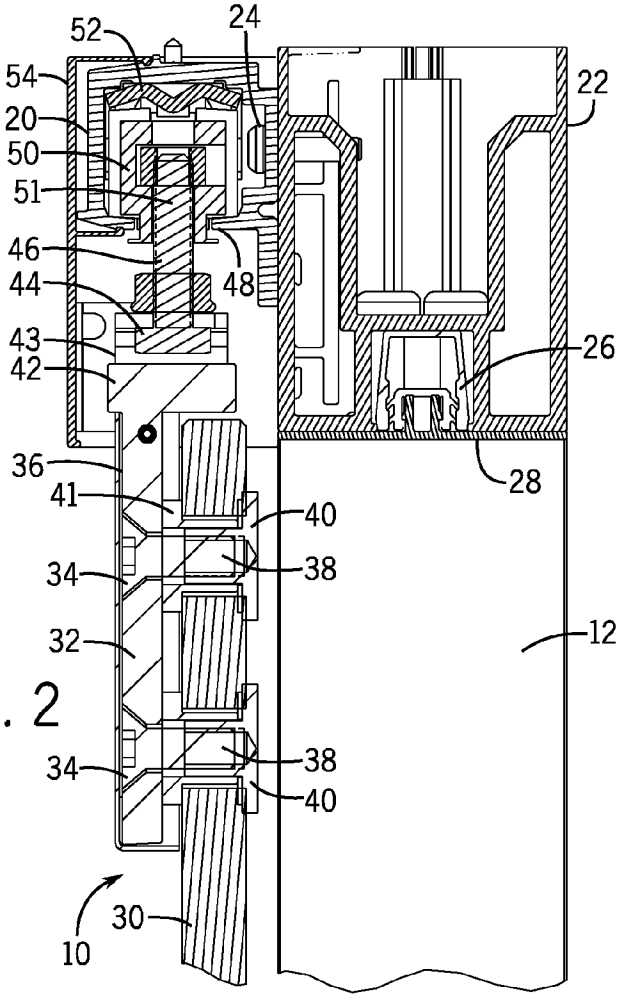
FIG. 2 is a section view taken along line 2-2 of FIG. 1*a* of the sliding glass door assembly.

FIG. 2 is a section view taken along line 2-2 of FIG. 1 and illustrates the attachment of the door track 20 to a door frame header 22. The door track 20 is an extruded component that is securely attached to the door frame header 22 through a series of connectors 24. The connectors 24 are spaced along the length of the header 22 such that the door track 20 can be securely supported on the header 22. As can be understood in FIG. 1, the door track 20 extends past the door frame header 22 and past the vertical post 12 that defines one side of the doorway. The header 22, in turn, is supported by the pair of vertical posts 12 and defines the top of the doorway. The extruded aluminum header 22 includes an insert 26 that receives a trim piece 28 to provide a finished appearance for the lower surface of the header 22.

As illustrated in FIG. 2, the sliding glass door 10 includes a glass panel 30 that is slidably supported relative to the stationary door track 20 by a pair of mounting brackets 32. Each of the mounting brackets 32 receives a pair of connectors 34 that extend through an outer face 36 of the mounting bracket 32. Each of the connectors 34 includes a threaded end 38 that is received by an internally threaded receiver 40. A resilient bushing 41 is positioned in each of the mounting holes formed in the glass panel 30 to protect the glass from the connectors 34 and receiver 40. The combination of the receiver 40 and the connector 34 connects the mounting bracket 32 to the glass panel 30 as illustrated.

Figure 3:
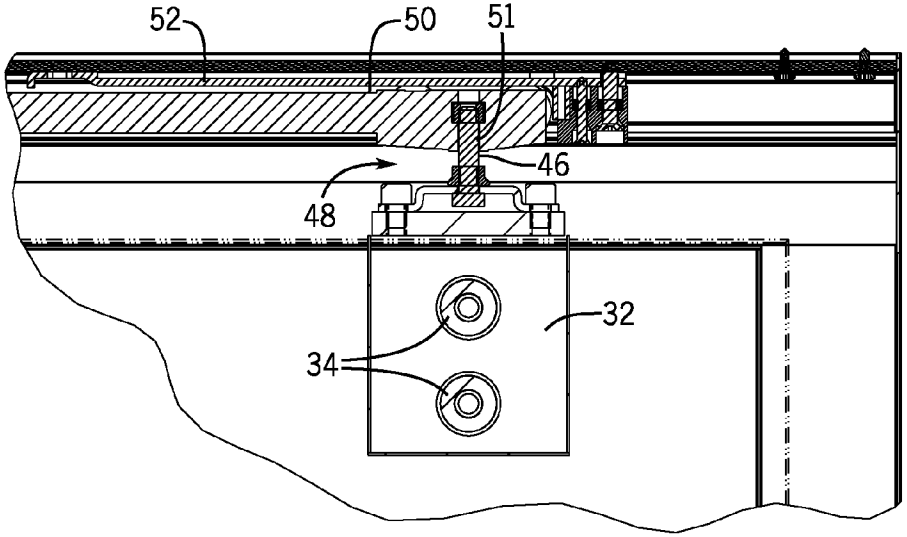
FIG. 3 is a partial section view taken through the top support frame.
Figure 3A:
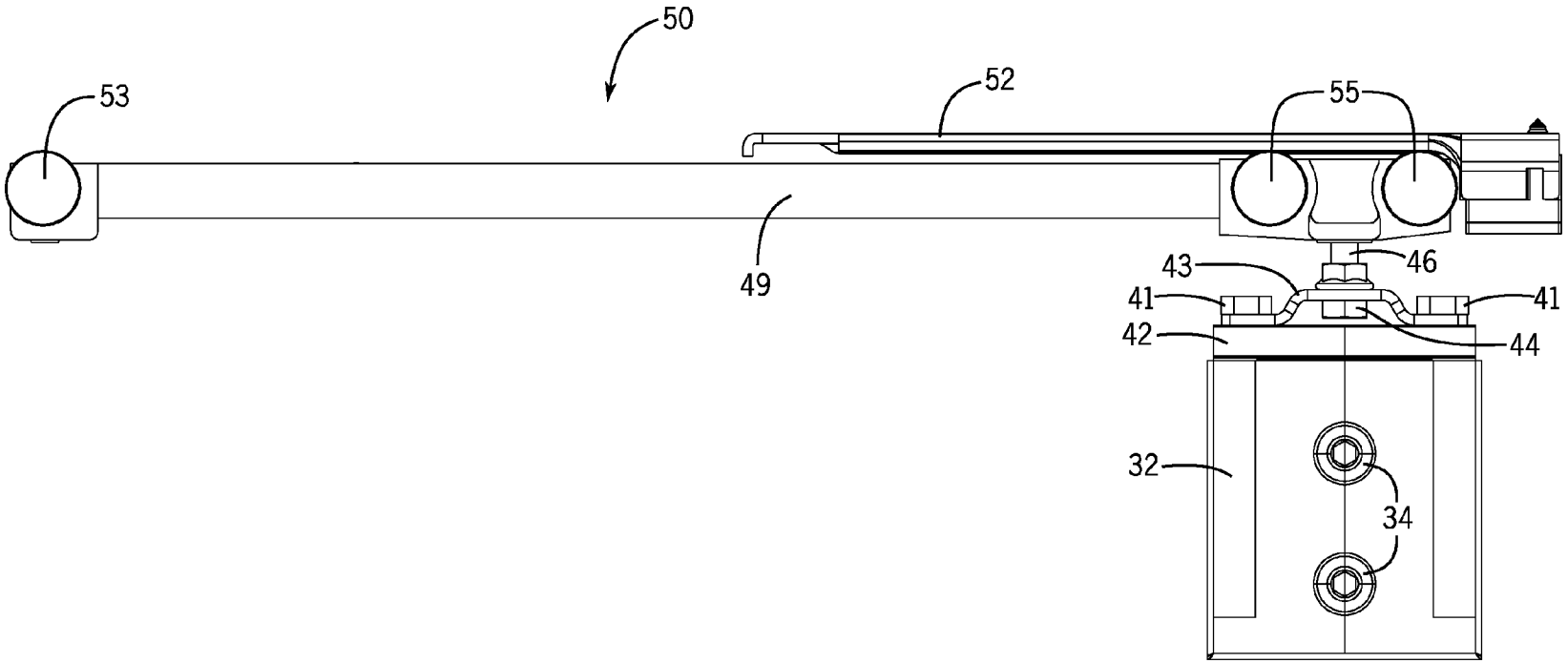
FIG. 3*a* is a side view showing the trolley assembly used to support the sliding glass door.

The upper end 42 of the mounting bracket 32 includes a support plate 43 connected to the upper end by a pair of screws 41, as shown in FIG. 3*a*. As shown in FIG. 2, a connector 44 having a connecting post 46 extends upward through an access opening 48 formed in the door track 20 and is received within a trolley 50. The end 51 of the connecting post 46 is preferably threaded such that the distance between the trolley 50, and thus the door track 20, can be adjusted to adjust the effective height of the sliding glass door. The trolley 50 is movable within the door track 20.

The trolley 50 is more clearly shown in the side view of FIG. 3*a*. The trolley 50 and includes a support bar 49 that includes a pair of front rollers 53 and rear rollers 55. Both the front and rear rollers 53, 55 are entrapped within the sliding door track 20, as can be understood in FIG. 2. Each of the rollers 53, 55 travels along the length of the sliding door track 20 to permit smooth sliding movement of the sliding glass door. A top support bar 52 holds the trolley in the position indicted in FIGS. 2 and 3.

As illustrated in FIG. 2, an outer valence 54 is attached to the door track 20 to provide a visually desirable appearance to the outer surface of the door track 20.

Figure 4:
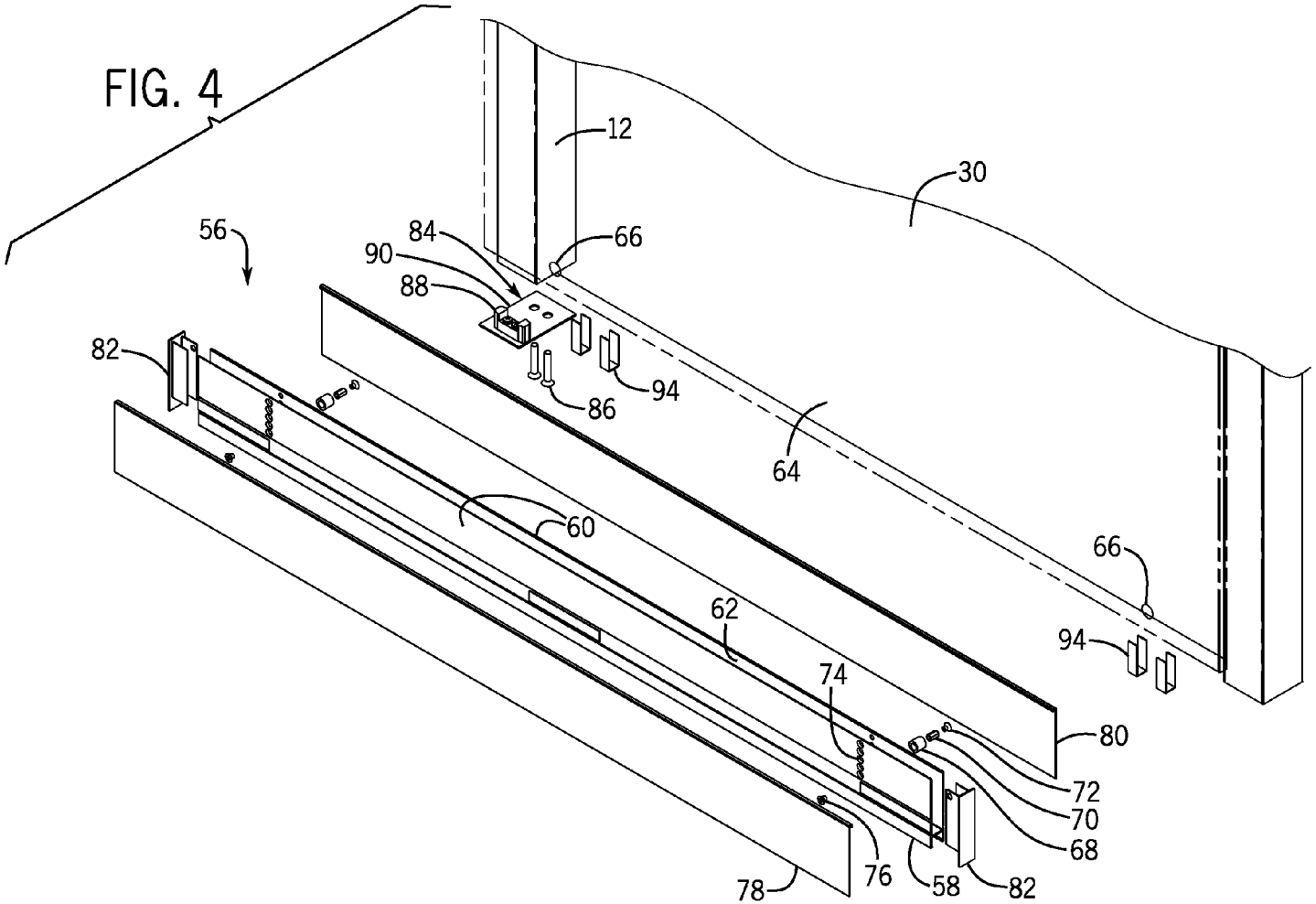
FIG. 4 is an exploded view of the lower trim used on the sliding glass door.
Figure 6:
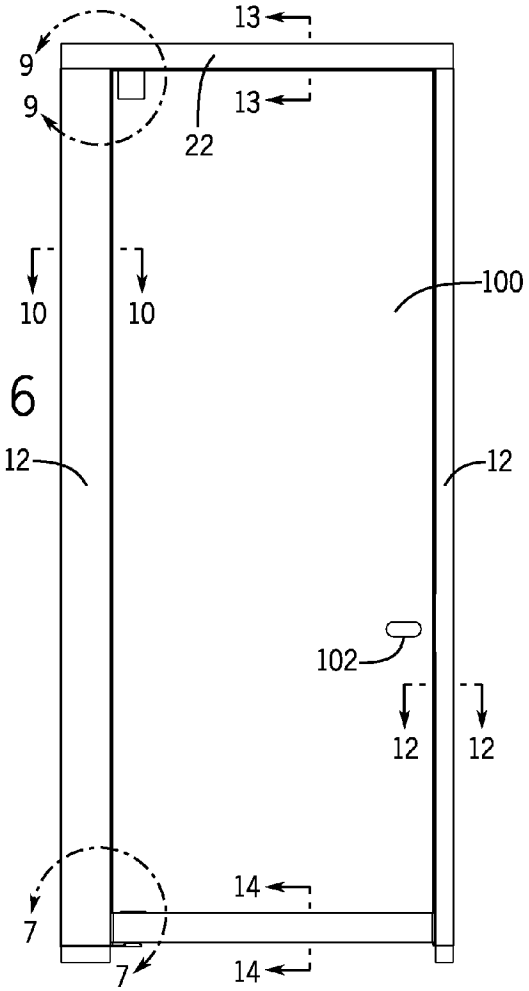
FIG. 6 is a front view of a pivoting glass door used with the wall system.

Referring back to FIG. 1*a*, the bottom of the glass door 10 includes an adjustable lower trim assembly 56 that provides a visually desirable appearance for the bottom surface of the sliding glass door 10. FIG. 4 illustrates the details of the lower trim assembly 56. The lower trim assembly 56 includes an adjustable bottom clamp 58 that includes a pair of spaced vertical sidewalls 60 that are spaced to define an open receiving channel 62. The receiving channel 62 is sized to receive the width of the bottom end 64 of the glass panel 30, as best shown in FIG. 5.

Referring back to FIG. 4, the bottom end 64 of the glass panel 30 includes a pair of mounting holes 66. The mounting holes 66 are used to secure the bottom clamp 58 to the bottom end 64 of the glass panel 30. Specifically, a bushing 68 is positioned within the mounting hole 66 and a standoff 70 and screw 72 extend through one of the spaced attachment holes 74 and is received by a corresponding nut 76. The spaced attachment holes 74 allow the bottom clamp 58 to move upward or downward relative to the glass panel 30 such that the location of the bottom clamp 58 can be adjusted as needed. The adjustability between the bottom clamp and the glass panel 30 of the sliding door allows for slight adjustments to closely space the bottom of the sliding door to the floor.

Figure 5:
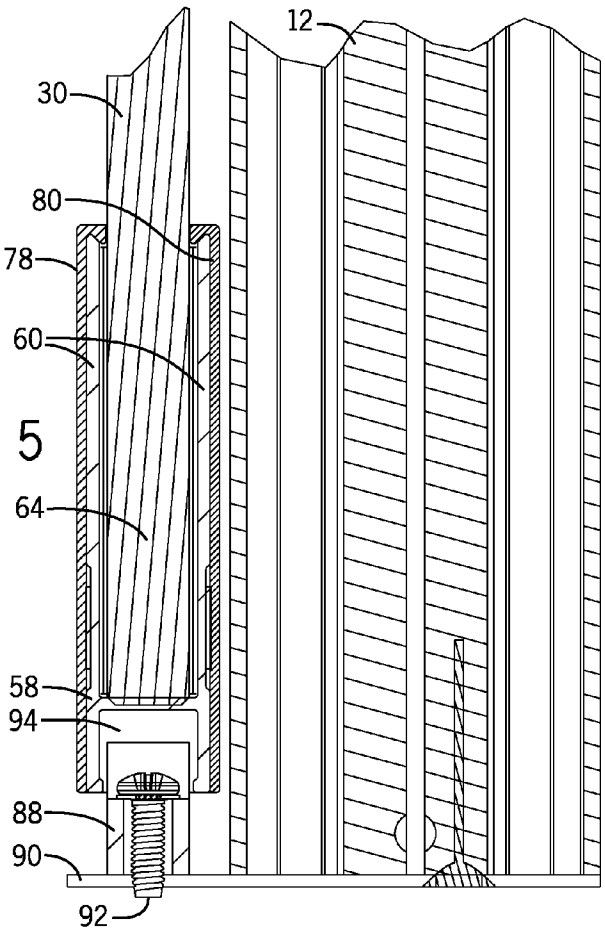
FIG. 5 is a section view showing the attachment of the lower trim to the sliding glass door.

As can be understood in FIGS. 4 and 5, a front cover 78 and a back cover 80 are received on the sidewalls 60 of the bottom clamp 58 to provide a visually desirable appearance for the lower trim assembly. The front and back covers 78, 80 can be formed of different types of material, such as a coated plastic or metal to provide the desired appearance of the lower end of the sliding door.

Referring back to FIG. 4, a pair of end caps 82 are attached to each end of the bottom clamp 58 to complete the visual appearance of the lower end of the sliding glass door.

A lower guide assembly 84 is positioned in alignment with one of the vertical support posts 12. The lower guide assembly 84 is mounted to the bottom end of the support post 12 by a pair of connectors 86. The lower guide assembly 84 includes a guide block 88 that is secured to an attachment plate 90 by a series of attachment screws 92 as shown in FIGS. 4 and 5. A pair of gaskets 94 are mounted to each side of the bottom end 64 of the glass door 30 to cushion the insertion of the bottom end 64 into the bottom clamp 58.

As can be understood in FIG. 5, the guide block 88 is received within a lower cavity 96 defined by the bottom clamp 58 to guide the sliding movement of the glass panel 30.

FIGS. 6-14 illustrate the details of a pivoting glass door 100 that can be mounted for pivoting movement between the pair of spaced vertical posts 12. The pivoting glass door 100 can be used in place of the sliding glass door 10 shown in the embodiments of FIGS. 1*a*-5 or can be used with a different room 15, as shown in FIG. 1. The pivoting glass door 100 is movable within the doorway defined by the spaced vertical posts 12 and the horizontal header 22. The door 100 includes a handle 102 that allows the door to pivotally open about a lower pivot assembly and an upper pivot assembly, the details of which will be described in detail below.

Figure 7:
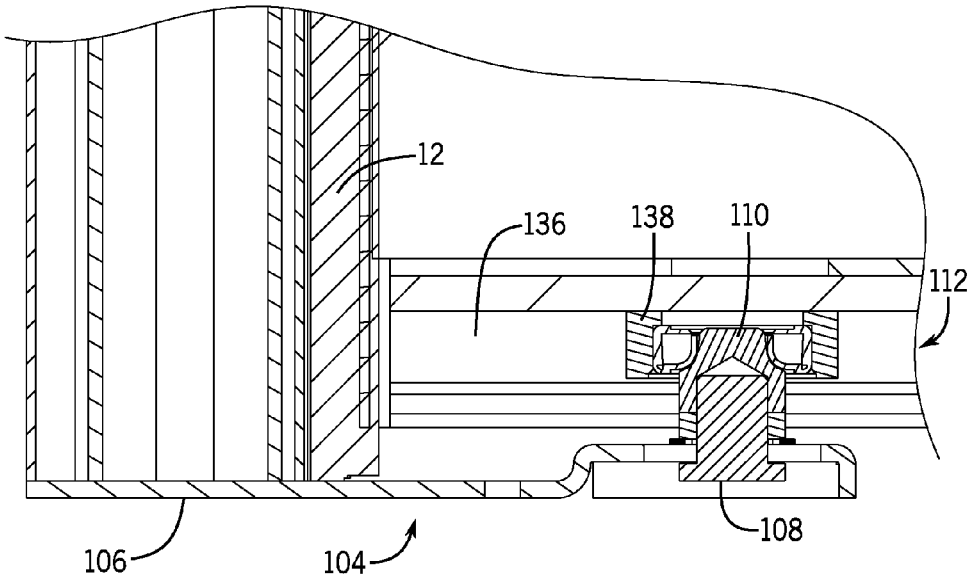
FIG. 7 is a section view showing detail 7-7 of FIG. 6.

FIG. 7 illustrates the lower pivot assembly 104 that is mounted to the bottom end of the vertical support posts 12. The lower pivot assembly 104 includes a pivot plate 106 that is positioned between the lowermost portion of the vertical support posts 12 and the ground. The pivot plate 106 receives a pivot bolt 108 that is received within an adjustable pivot receiver 110 of a bottom assembly 112.

Figure 14:
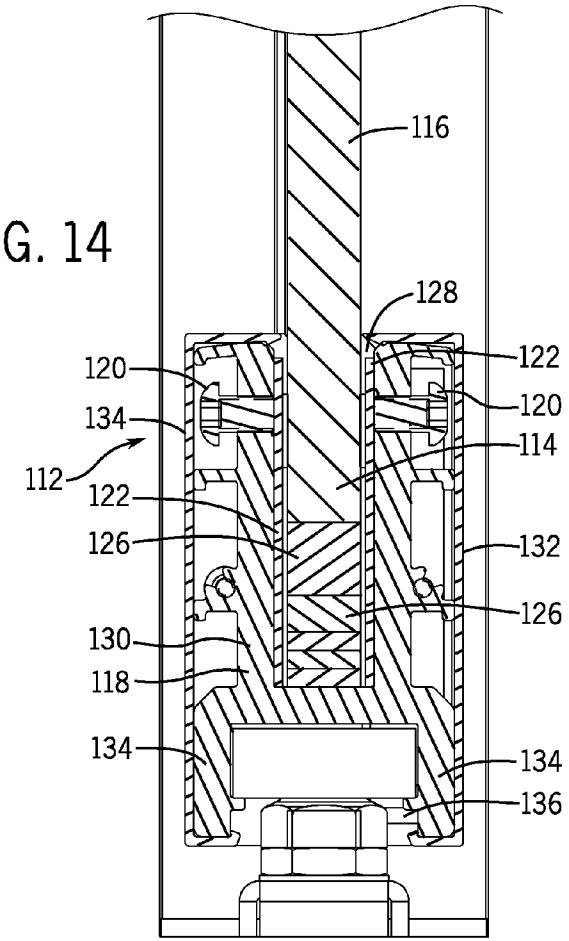
FIG. 14 is a section view taken along line 14-14 at the bottom end of the pivoting door.

Referring now to FIG. 14, the bottom assembly 112 is securely attached to the bottom edge 114 of the glass panel 116. The bottom assembly 112 includes an adjustable mounting block 118 that is securely attached to the bottom edge 114 of the door 116 through a pair of set screws 120. The mounting block 118 receives a pair of side shims 122 that are located on opposite sides of the glass panel 116. The side shims 122 are included to create a tighter fit between the glass panel 116 of the pivoting door and the vertical sidewalls 130 of the mounting block 118. As illustrated in FIG. 14, the bottom edge 124 of the glass panel 116 contacts a bottom shim 126 positioned within the open cavity 128 defined between the pair of spaced vertical sidewalls 130. In the embodiment shown, four separate bottom shims 126 are stacked on top of each other within the open cavity 128. The bottom shims 126 can have different thicknesses varying from ½ inch to ⅛ inch such that different combinations of the bottom shims 126 can vary the location of the bottom edge 114. Since the pair of set screws 120 holds the mounting block 118 on the bottom edge 114, the position of the mounting block can be adjusted to adjust the overall height of the pivoting glass door. In the embodiment shown, the total adjustment from the lower shim 126 to each of the set screws 120 is approximately 1.75 inches. In this manner, the bottom assembly 112 can slightly adjust the overall height of the glass panel 116 that forms the pivoting door.

As illustrated in FIG. 14, trim sections 132 are each mounted to the mounting block 118 to provide a more visually desirable appearance for the bottom assembly 112. Each of the trim sections 132 is securely held in place as illustrated.

Figure 15:
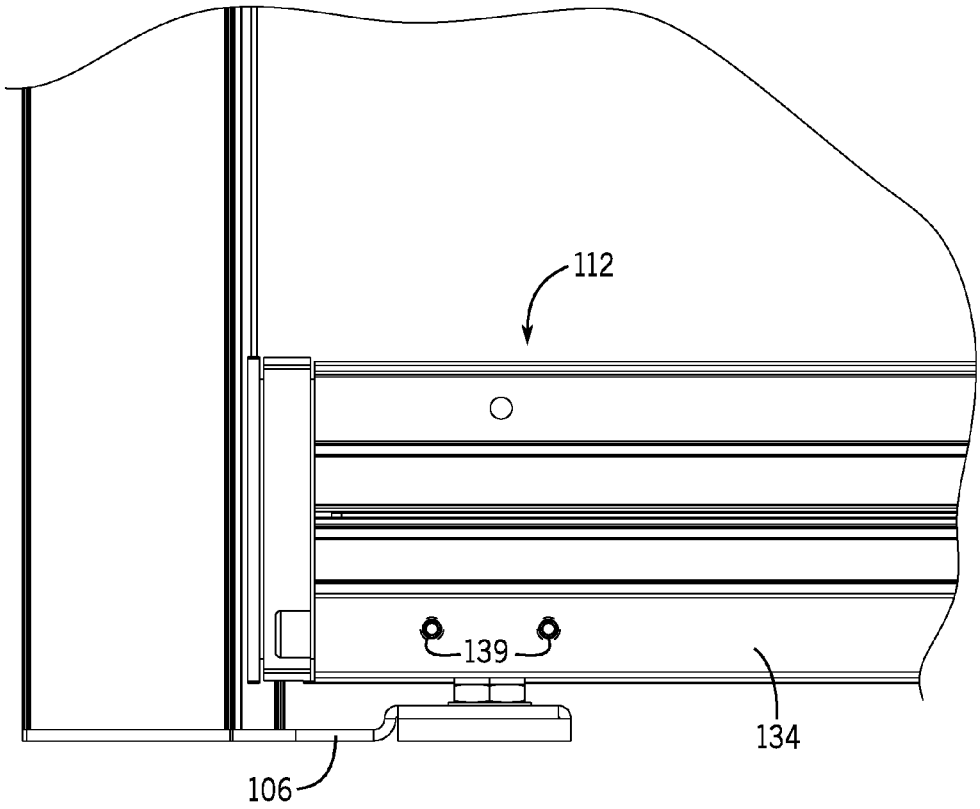
FIG. 15 is a partial side view showing the attachment of the bottom pivot block.

As illustrated in FIG. 14, a pair of bottom flanges 134 of the mounting block 118 defines an open receiving cavity 136. As illustrated in FIG. 7, the open receiving cavity 136 includes the bottom pivot block 138 that in turn receives the pivot member 110 and the pivot bolt 108. As shown in FIG. 15, a pair of set screws 139 extends through the bottom flange 134 and engages the bottom pivot block to hold the pivot block within the mounting block. The location of the bottom pivot block can be adjusted in or out to control the swing of the pivoting glass door.

Figure 13:
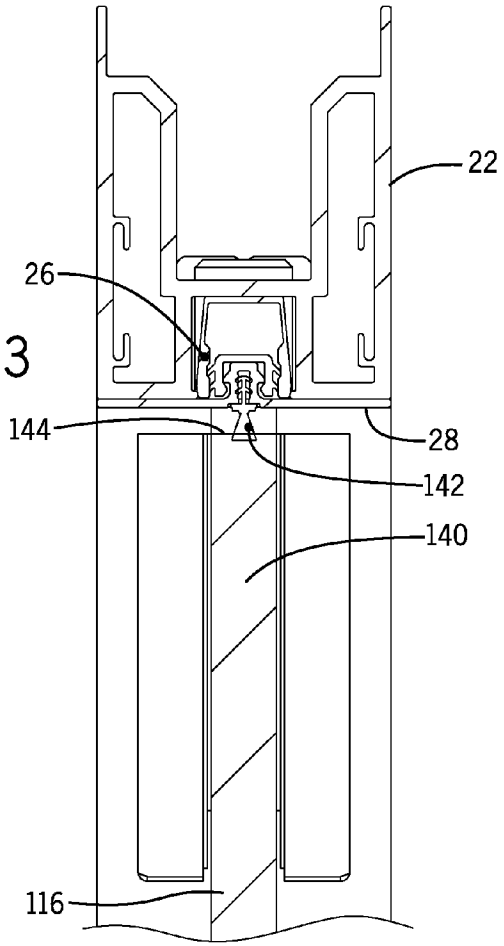
FIG. 13 is a section view taken along line 13-13 of FIG. 9.

FIG. 13 is a cross-section view illustrating the interaction between the top end 140 of the glass panel 116 that forms the swinging door and the header 22. In the embodiment shown in FIG. 13, the trim piece 28 mounted to the top header 22 includes a weather strip 142 that extend vertically below the trim piece 28 and engages a top surface 144 of the glass panel 116. The weather strip 142 provides a seal between the top header 22 and the glass panel 116 of the swinging door.

Figure 8:
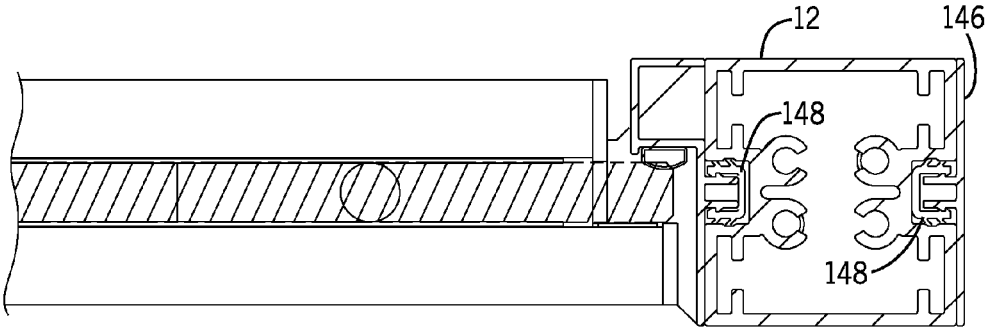
FIG. 8 is a section view of one of the support posts.

FIG. 8 is a bottom view showing one of the vertical posts 12. The vertical post 12 includes outer trim sections 146 that are received within clips 148.

FIG. 9 is a detail, partial section view illustrating the pivoting connection between the top of the pivoting glass door 100. The top end of the door includes a gasket 150 that is received in a top portion of the door. The gasket 150 provides support for a bias spring 152 which in turn acts upon a plunger 154. The plunger 154 extends into an upper pivot bushing 156 and has a sloped upper surface 158. The sloped upper surface 158 allows the top end of the pivoting glass door to be moved into position to initially depress the plunger 154 against the bias force created by the bias spring 152. Once the door is properly located, the bias spring 152 forces the sloped upper surface 158 into the upper pivot bushing 156. When in this position, the plunger 154, along with the lower pivot bolt 108 shown in FIG. 7, defines the pivot axis for the pivoting glass door.

As can be understood in the drawing figures, the weight of the pivoting glass door is supported on the floor rather than by hinges attached to the vertical support posts 12. The pivot axis defined by the lower pivot bolt 108 and the plunger 154 is spaced from the vertical support posts 12. Since one of the vertical support posts 12 do not need to support the entire weight of the pivoting glass door, the size of the vertical support posts 12 can reduced.

FIG. 10 is a section view taken along line 10-10 that illustrates the configuration of the vertical post and the inner edge 160 of the pivoting glass door 100. A pivot housing 166 is connected through the glass panel by a pair of mounting screws 168 that are each received within an attachment nut 170. The spring 152 is shown in its compressed condition within the pivot housing 166. Vertical post 12 includes a molding 162 having a resilient bulb seal 164.

FIG. 11 is a section view that shows the attachment of the pivot plate 106 through the use of one or more screws 172. The pivot plate 106 is located beneath the bottom edge of the vertical support post 12 and the ground.

FIG. 12 is a section view showing the attachment of a molding to an inner surface of the vertical support post 12. The molding 174 acts as a door stop and limits the movement of the pivoting glass door 100 to only one direction. The molding 174 includes a resilient bulb seal 176 that contacts the inner surface 178 of the pivoting glass door 100 when the glass door is in the closed position illustrated. The molding 174 includes a strike plate weldment 180 that is attached to the support post 12 through a screw 182. The strike plate weldment 180 is securely attached over the length of the vertical support post 12.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A modular wall system for use in a building having a floor, comprising:

a series of individual wall panels;

a pair of spaced vertical posts positioned to support a horizontal header to define a doorway;

a pivoting glass door pivotally mounted to open and close the doorway;

a bottom pivot assembly mounted to a bottom end of the pivoting glass door to support the bottom end of the door on the floor, wherein the bottom pivot assembly includes a unitary mounting block having a first cavity that receives the bottom end of a glass panel of the glass door such that the mounting block is securely attached to the bottom end of the pivoting glass door, wherein the mounting block further includes a second cavity that receives a pivot pin supported on the floor and wherein the position of the bottom end of the pivoting glass door within the first cavity of the mounting block is adjustable; and a top pivot assembly mounted to a top end of the pivoting glass door to pivotally retain the pivoting glass door relative to the top header.

2. The modular wall system of claim 1 wherein the mounting block is attached to the bottom end of the glass door by a plurality of set screws.

3. The modular wall system of claim 1 wherein the top pivot assembly includes a plunger received within the upper header to pivotally support the top end of the pivoting glass door.

4. The modular wall system of claim 3 wherein the plunger is biased into an extended position by a bias spring.

5. The modular wall system of claim 4 wherein an upper end of the plunger includes a sloped upper surface.

6. The modular wall system of claim 1 further comprising a pivot block received within an open interior of the mounting block, wherein the position of the pivot block is adjustable within the mounting block.

7. A modular wall system for use in a building having a floor, comprising:

a series of individual wall panels;

a pair of spaced vertical posts positioned to support a horizontal header to define a doorway;

a pivoting glass door pivotally mounted to open and close the doorway;

a bottom pivot assembly mounted to a bottom end of the pivoting glass door to support the bottom end of the door on the floor, wherein the bottom pivot assembly includes a mounting block securely attached to the bottom end of the pivoting glass door, wherein the mounting block receives a pivot pin supported on the floor and wherein the position of the bottom end of the pivoting glass door within the mounting block is adjustable;

a top pivot assembly mounted to a top end of the pivoting glass door to pivotally retain the pivoting glass door relative to the top header; and a pair of cover sections attached to the mounting block to conceal the bottom clamp.

8. A modular wall system for use in a building having a floor, comprising:

a series of individual wall panels;

a pair of spaced vertical posts positioned to support a horizontal header to define a doorway;

a pivoting glass door pivotally mounted to open and close the doorway;

a bottom pivot assembly mounted to a bottom end of the pivoting glass door to support the bottom end of the door on the floor, wherein the bottom pivot assembly includes a mounting block securely attached to the bottom end of the pivoting glass door, wherein the mounting block receives a pivot pin supported on the floor and wherein the position of the bottom end of the pivoting glass door within the mounting block is adjustable;

a top pivot assembly mounted to a top end of the pivoting glass door to pivotally retain the pivoting glass door relative to the top header; and pivot block received within an open interior of the mounting block, wherein the position of the pivot block is adjustable within the mounting block, wherein the pivot block receives the pivot pin.

* * * * *